US005413656A

United States Patent [19]

Kühnhold et al.

[11] Patent Number: 5,413,656

[45] Date of Patent: May 9, 1995

[54] METHOD AND DEVICE FOR EXCHANIGN WINDINGS ROLLS

[75] Inventors: Michael Kühnhold; Wolfgang Fischer, both of Düsseldorf; Hartmut Dropczynski, Dormagen, all of Germany

[73] Assignee: Jagenberg Aktiengesellschaft, Dusseldorf, Germany

[21] Appl. No.: 169,961

[22] Filed: Dec. 20, 1993

Related U.S. Application Data

[63] Continuation of Ser. No. 856,070, May 7, 1992, abandoned.

[30] Foreign Application Priority Data

Sep. 14, 1990 [DE] Germany ..... 40 29 180.4

[51] Int. Cl.[6] ..... B31C 13/00

[52] U.S. Cl. ..... 156/184; 156/187; 156/252; 156/257; 156/464; 156/519

[58] Field of Search ..... 156/184, 185, 187, 247, 156/269, 270, 252, 257, 464, 517, 519, 522

[56] References Cited

U.S. PATENT DOCUMENTS

| | | | |
|---|---|---|---|
| 2,314,519 | 3/1943 | Schultz et al. | 118/42 |
| 2,745,464 | 5/1956 | Auerbacher | 156/504 |
| 3,146,152 | 8/1964 | Seragnoli | 156/519 |
| 3,322,600 | 5/1967 | Harrison et al. | 156/461 |
| 3,630,801 | 12/1971 | Booth | 156/197 |
| 3,869,095 | 3/1975 | Diltz | 242/531 |
| 4,181,559 | 1/1980 | Hudson | 156/389 |
| 4,759,816 | 7/1988 | Kasper et al. | 156/247 X |
| 4,775,110 | 10/1988 | Welp et al. | 242/56.8 |

FOREIGN PATENT DOCUMENTS

| | | |
|---|---|---|
| 2625486 | 7/1989 | France . |
| 3228255 | 7/1982 | Germany . |
| 3207461 | 9/1983 | Germany . |
| 2162775 | 4/1987 | Germany . |
| 3611895 | 10/1987 | Germany . |
| 3151007 | 12/1989 | Germany . |
| 4003504 | 8/1991 | Germany . |
| 2188911 | 10/1987 | United Kingdom . |

OTHER PUBLICATIONS

Patents Abstracts of Japan M-966 Jul. 9, 1990 vol. 14/No. 319.

*Primary Examiner*—David A. Simmons
*Assistant Examiner*—Paul M. Rivaro
*Attorney, Agent, or Firm*—Herbert Dubno; Andrew Wilford

[57] ABSTRACT

A method of winding a continuous web on a succession of cores comprises the steps of sequentially rotating a core to which the web is attached to longitudinally advance the web and wind it on the core while applying a strip of adhesive to a transfer roller and then stopping rotation of the core. Subsequently a crosswise row of perforations is formed in the web offset from the core and then the web is longitudinally advanced while pressing the roller against the web to transfer the adhesive strip to the web at and immediately upstream and downstream from the perforation row. The web is subsequently differentially. longitudinally advanced web upstream and downstream of the perforation row to tear the web longitudinally apart at the perforation row, thereby forming a trailing web end attached to the web wound on the core and a leading web end each carrying some of the adhesive strip. The trailing web end is then pressed against the web on the core to adhere it thereto and the core is replaced with a fresh core and then the leading web end is adhesively attached to the fresh core. At the end the web is again advanced the web and wound on the fresh core while applying another adhesive strip to the transfer roller.

6 Claims, 5 Drawing Sheets

METHOD AND DEVICE FOR EXCHANIGN WINDINGS ROLLS

CROSS REFERENCE TO RELATED APPLICATIONS

This application is a file-wrapper continuation of now abandoned application No. 07/856,070, filed 7 May 1992 as the US national phase of PCT/EP91/01624 itself filed 26 August 1991 with a claim to the priority of German Pat. No. 40 29 180.4 filed 14 September 1990.

FIELD OF THE INVENTION

The invention relates to a method for changing winding rolls in machines for winding webs of material onto cores, particularly paper or cardboard webs, and to a device for implementing the method.

BACKGROUND OF THE INVENTION

In a winding machine for winding webs of material into rolls, the aim is to keep the downtime of the machine required for roll changing as low as possible. Thereby it also has to be insured that the initial portion of the new web resulted after cutting is securely fastened to the new winding core and/or the web end is securely fastened to the full winding roll.

The DE No. 36 11 895-A1 describes a generic method used in a winding machine with support cylinders, wherein the web of material is first weakened before it reaches the support cylinder, a trace of adhesive is then applied to both sides of the weakened portion and the web of material is separated by braking on the support cylinder. The web ends held on the support cylinder due to vacuum are moved towards the full winding rolls and glued thereto. The newly created web beginnings remain braked until the full rolls are discharged and new rolls are inserted, then the brake is released and the web beginnings provided with adhesive strips are transported by the support cylinder to the winding cores and glued thereto.

In DE No. 40 03 504-A1 a winding machine with support cylinders is described, wherein on the incoming side a perforating mechanism is provided, as well as a number of adhesive-tape dispenser across the work width for the application of two-sided adhesive tape, these dispensers delivering their tape in the direction of web travel. This way, the application of adhesive tape takes place due to the moving web. Now, it has been found that in the case of paper or cardboard webs it is necessary to provide either a wide adhesive strip running all the way across the web width, or in the case of the application in the travel direction of the web, an adhesive strip at approximately every 200 mm. In the case of wide web width (e.g. 8 m), the application of an adhesive strip across the width requires a lot of time, or - in the case of application in the travel direction of the web - a large number of adhesive-tape dispensers are required.

OBJECTS OF THE INVENTION

It is the object of the invention to improve the generic method so that for the application of the adhesive strips only one adhesive-tape dispenser is required, without increasing the downtime of the machine.

These objects are attained according to this invention in a method of winding a continuous web on a succession of cores comprising the steps of sequentially rotating a core to which the web is attached to longitudinally advance the web and wind it on the core while applying a strip of adhesive to a transfer roller and then stopping rotation of the core. Subsequently a crosswise row of perforations is formed in the web offset from the core and then the web is longitudinally advanced while pressing the roller against the web to transfer the adhesive strip to the web at and immediately upstream and downstream from the perforation row. The web is subsequently differentially longitudinally advanced web upstream and downstream of the perforation row to tear the web longitudinally apart at the perforation row, thereby forming a trailing web end attached to the web wound on the core and a leading web end each carrying some of the adhesive strip. The trailing web end is then pressed against the web on the core to adhere it thereto and the core is replaced with a fresh core and then the leading web end is adhesively attached to the fresh core. At the end the web is again advanced the web and wound on the fresh core while applying another adhesive strip to the transfer roller.

According to the invention only one adhesive dispenser is required, which at first applies the adhesive strip to the transfer element. This can be done during the web-winding operation, so that the downtime does not have to be increased. If the roll change takes place at shorter time intervals than required for the application of adhesive strips to the transfer element, two adhesive dispensers applying adhesive strips to the transfer element from both sides simultaneously over the work width are sufficient.

A freely running transfer roller touching the web of material makes possible the application of adhesive strips by means of the moving web.

In an advantageous variant of roll changing for heavier paper kinds, such as cardboard, the web is weakened at first and adhesive strips are applied to both sides of the weakened line. Subsequently, the weakened line can be moved into the position desired for gluing the new web beginnings to the new cores. After the web is sectioned, both the web end - to be glued to the full winding rolls - as well as the newly created web beginning - to be glued to the new winding cores - are provided with adhesive strips.

BRIEF DESCRIPTION OF THE DRAWING

The drawing serves for the clarification of the invention with the aid of the embodiment examples represented in a simplified manner.

Specific Description

Figure 1:
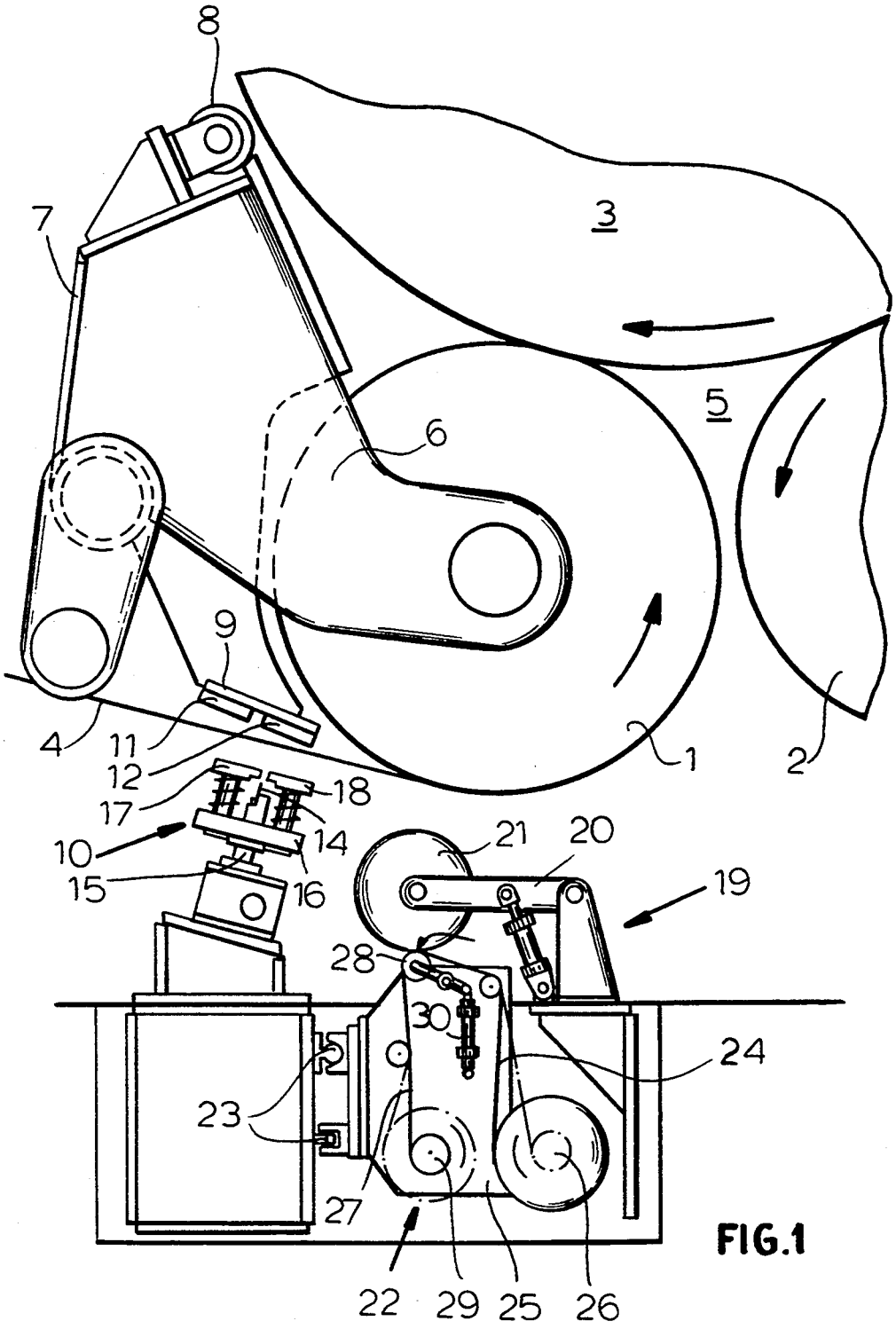
FIGS. 1 and 2 show lateral views of a device for the application of adhesives, which when used in a winding machine applies several adhesive strips running in the direction of web travel, at a distance from each other.

The winding machine with support cylinders has two support cylinders 1, 2, on which the winding rolls 3 rest during the winding process. The web 4, preferably a paper or cardboard web, separated longitudinally into individual webs is redirected from underneath by support cylinder 1, guided through the gap between the support cylinders 1, 2 into the cylinder cradle 5 and wound onto aligned cores. Such winding machines with double support cylinders are widely known and described for instance in DE-OS 32 07 461, so that it is not necessary to go into details as long as they do not concern the invention.

At both ends of the support cylinder 1 on the incoming side, levers 6 swingable about the axis of the support cylinder are fastened, these levers supporting a swing traverse 7 extending across the entire work width. On the upper side of swing traverse 7, a freely rotatable discharge roller 8 is mounted for the discharge of full winding rolls 3 over and away from the support cylinder 2. On its lower side, the swing traverse 7 has a counterbracket 9 opposite to the perforating device 10, this bracket extending over the entire work width and having two support surfaces 11, 12 with a groove in between. By moving the swing traverse 7, the support surfaces 11, 12 - as shown in FIG. 2 - can be moved against the web.

Figure 2:
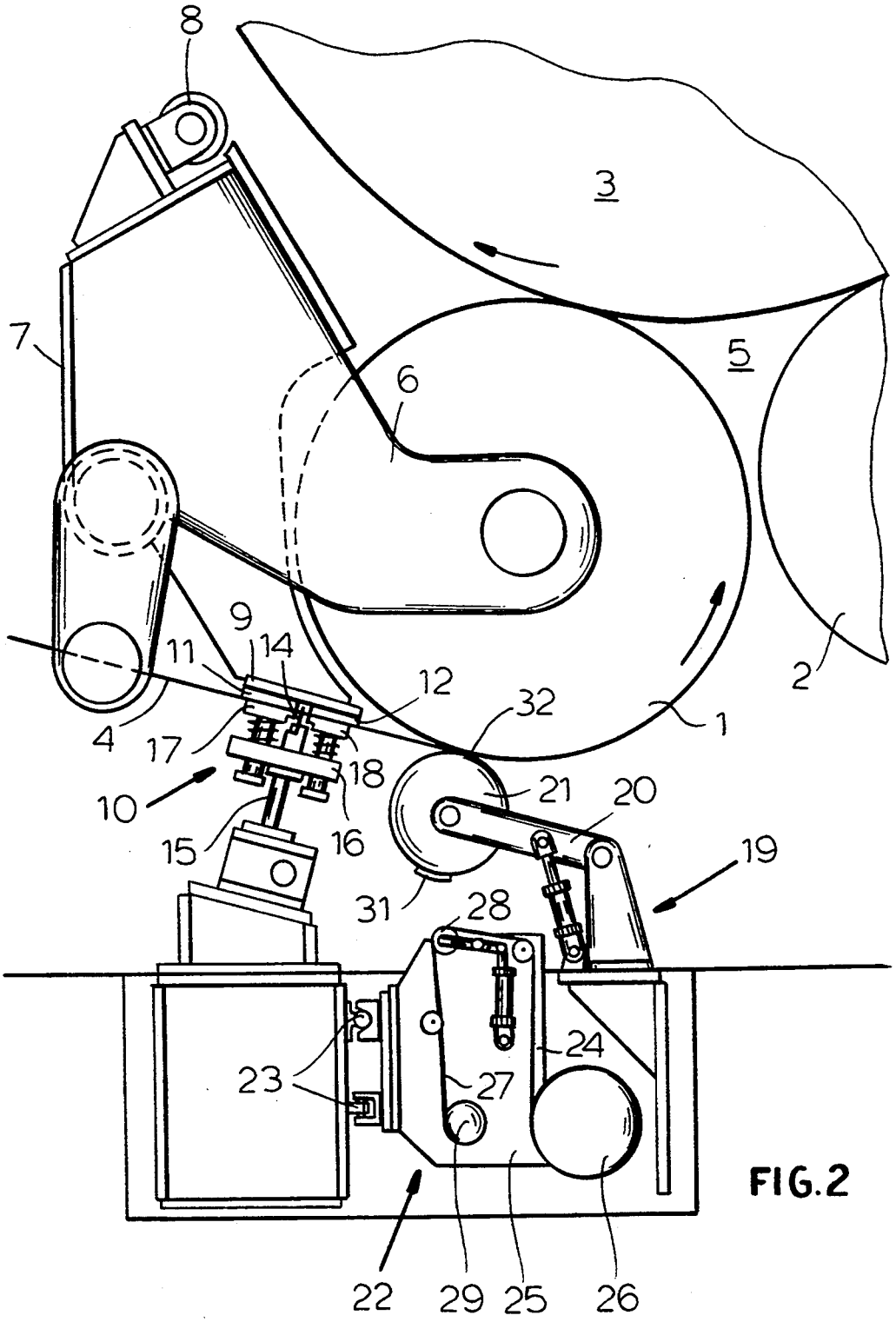

The perforating device 10 has a serrated knife 14 extending over the working width, which by means of a lifting unit 15 can be removed from the web and - as shown in FIG. 2 - can also be pressed into the groove of the lowered counterbracket 9, for the perforation of web 4. In order to hold the web 4 while it is being perforated, two clamping elements 17, 18 are provided, which are spring-supported on the knife holder 16 laterally with respect to the knife 14, and can be pressed against the support surfaces 11, 12 of the counterbracket 9.

A device 19 for the application of the adhesive is mounted underneath the support cylinder 1. It has a transfer roller 21 extending over the work width, which is rotatably supported on swivel arms 20 by means of a drive and which can be moved from below against the web 4 in the area where it wraps about the support cylinder 1. The surface of the transfer roller 21 is so structured that the adhesive clings less to it than to the material web 4, i.e. it has a lower degree of adhesion than the material web 4.

Figure 3:
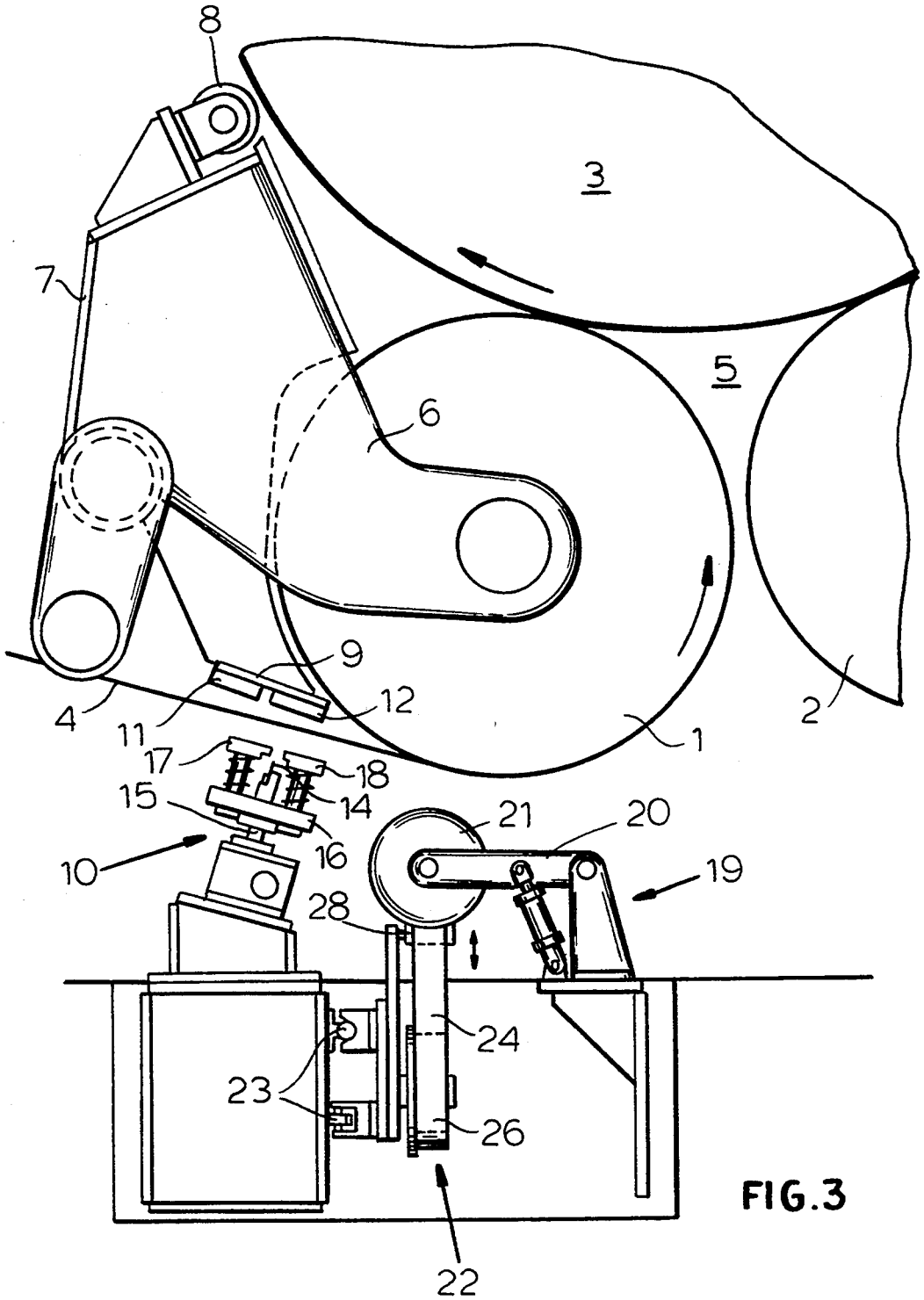
FIG. 3 shows a device for the application of adhesives which applies a wide adhesive strip across the travel direction of the web.

According to FIGS. 1 to 3, underneath the transfer roller 21 an adhesive-tape dispenser 22 is provided, which is supported on guides 23 so that it can be moved across the work width-parallelly parallel with respect to the axis of the support cylinder. In the embodiment shown in FIGS. 1 and 2, the guidance of the adhesive tape 24 in the travel direction of web 4 is illustrated. For this purpose, a supply roll 26 made of an adhesive tape 24 consisting of a two-sided layer of adhesive applied to a substrate tape 27 is supported freely rotatable in a sliding carriage 25 travelling across the web. The adhesive tapes customary for the paper industry, whose layers of adhesive are very easily peeled off the substrate tape 27 are used. The adhesive tape 24 is moved upwardly on the sliding carriage 25 and guided against the travel direction of web 4 until it reaches a pressure roller 28 having the same width as the adhesive tape and which deflects it downwardly towards a driven spool 29 for the substrate tape 27. In order to apply the strips of adhesive to the transfer roller 21, the pressure roller 28 can be swung upwardly by means of a piston-cylinder unit 30 against the transfer roller 21 in its lowered position.

If shorter times for the application of the adhesive strips to the transfer roller 21 are required, - e.g. due to shorter roll changing times -, two or more simultaneously acting adhesive-tape dispensers are provided across the machine width.

FIG. 1 shows the winding machine with support cylinders during winding: the perforating device 10 and its counterbracket 9 are at a noninterfering distance from web 4. The transfer roller 21 is lowered, so that it too is at a distance from web 4. In this position several parallel adhesive strips 31 are applied to its surface longitudinally with respect to the running direction of web 4. Thereby the pressure roller 28 wrapped by the adhesive tape 24 swings from underneath against the transfer roller 21. By turning the transfer roller 21, the adhesive tape 24 rolls off the supply roll 26 and the transfer roller 21 picks up an adhesive strip 31. The remaining substrate tape 27 is wound on spool 29. After the desired length of adhesive strip has been applied to the transfer roller 21, the pressure roller 28 is moved away, whereby the adhesive layer of adhesive tape 24 is torn off. Subsequently, the sliding carriage 25 travels across the running direction of the web to the next adhesive-strip delivery position. At the same time, the transfer roller 21 is turned back into its receiving position, so that the received adhesive strips 31 are aligned. By pressing the pressure roller 28, the next adhesive strip 31 is now applied to the transfer roller 21. Depending on the width of web 4 a number of parallel adhesive strips 31, transversely aligned with respect to the running direction of web 4, are applied to the transfer roller 21, preferably this takes place approximately at every 200 mm. It is also possible to select the position of the adhesive strips 31 depending on the position of the longitudinal slitting knives, so that the adhesive strips 31 are evenly distributed over the individual webs.

When the winding roll 3 has reached a predetermined web length or a predetermined diameter, the winding machine with support cylinders is stopped. The web is stopped as a result of braking force applied by a unwinding device not shown in the drawing, under the action of web traction. Subsequently, the swing traverse 7 is moved downwards, so that support surfaces 11, 12 of the counterbracket 9 come to rest against the web 4 and the web is weakened by perforation. Thereby the sectioning knife 14 travels upwards and pokes with its points through the web 4 and into the groove between the support surfaces 11, 12. During perforation, the web 4 is clamped between the clamping elements 17, 18 and the support surfaces 11, 12 and thus is kept firmly stretched. At the same time - as shown in FIG. 2 - the transfer roller 21 swings from underneath against the support cylinder 1 and comes to rest against the web 4. The transfer roller 21 is thereby turned so that the peripheral distance between the contact 32 to web 4 and the middle of the adhesive strips 31 corresponds approximately to the distance between the contact line 32 and the sectioning knife 14. Subsequently, the sectioning knife 14 with the clamping elements 17, 28 is lowered and the transfer roller 21 is shifted to run freely. The support cylinder 1 is then started again with reduced web traction, whereby the transfer roller 21 in contact therewith is entrained in rotation. Thereby the adhesive strips 31 are pressed by compression against the web 4 at the contact line 32, whereby they roll off the transfer roller 21 and apply themselves to the web 4, since the adhesion of web 4 is higher than the adhesion of the transfer roller 21. In the meantime, the perforation line 33 of web 4 has also been advanced to the contact line 32 and therefore the adhesive strips 31 are now on both sides of the perforation line 33 on web 4 (FIG. 4).

After the adhesive strips 31 are applied to the web 4, the transfer roller 21 is again lowered and in this position it can receive adhesive strips for the next roll change. The web 4 is moved further, until the weakened web portion (perforation line 33) with the adhesive strips 31 is located in the cylinder cradle 5 above the gap between the support cylinders 1, 2. There the web is stopped and the brake at the unwinding device is arrested, in order to retain with maximum force. After that, the winding roll 3 is slightly lifted from the wrapped support cylinder 1 with the discharge roller 8 and rotated by means of support cylinder 2. Thereby the web 4 tears at the perforation line 33, so that adhesive strips 31 are present On both the outgoing web end and the newly created web beginning. The newly created web beginning is held at the support cylinder 1, this can be done for instance by suction due to suction or by mechanical holding means. The full winding roll is turned further, until the web end provided with adhesive strips 31 is moved through the contact line to support cylinder 1 or to discharge roller 8, in order to glue the web end to the full winding roll 3. Subsequently, the full winding roll 3 is pushed out by the discharge roller 8 over the support cylinder 2, and a new set of cores is introduced in the cylinder cradle 5. After a pressure roller (not shown in the drawing) is applied, the support cylinders 1, 2 are again set into motion in order to make the contact between the new initial portion of the web provided with adhesive strips 31 and the cores. A lasting adhesive connection between the web 4 and the cores is established after the web beginning with adhesive strips 31 has run through the gap between the cores and the support cylinder 1. After that the winding machine with support cylinders can be accelerated to the maximum winding speed.

Figure 5:
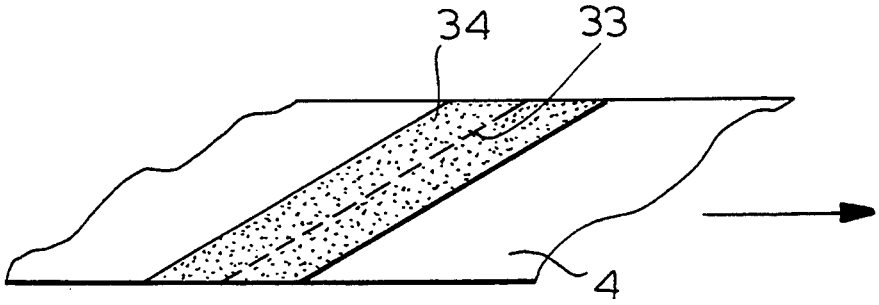
FIG. 5 shows a paper web with a wide adhesive strip running across the travel direction of the web.
Figure 6:
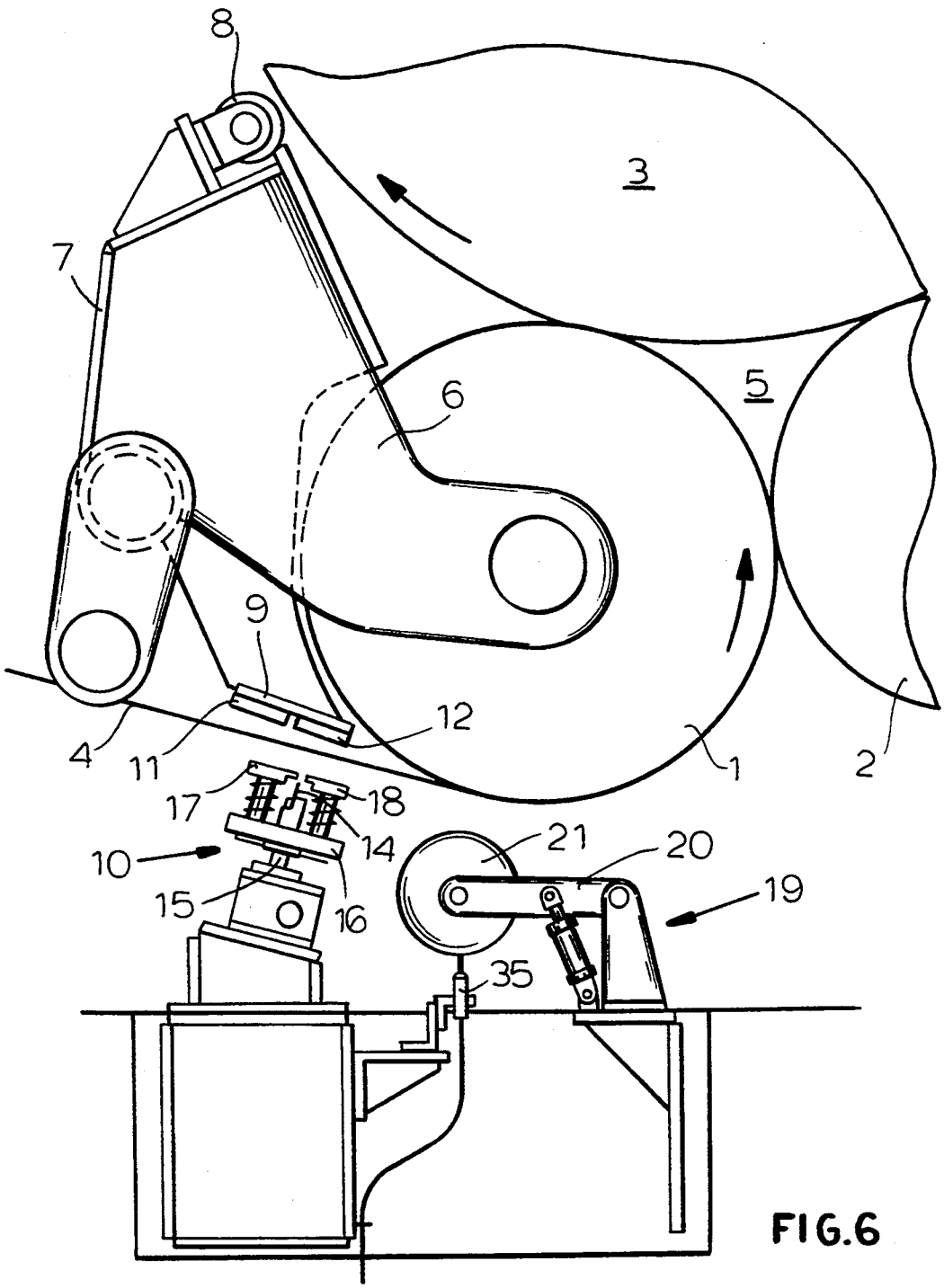
FIG. 6 shows a device for the application of adhesives by means of which one or more glue traces are applied.

In the embodiment of FIG. 3 a wide double-sided adhesive strip 34 is applied to the transfer roller 21 across the running direction of web 4, i.e. axially parallel (FIG. 5). Thereby, the sliding carriage 25 of the adhesive-tape dispenser 22 is supported so that it can be moved across the work width, whereby the axes of the pressure roller 28 and the supply roll 26 extend perpendicularly to the axis of the transfer roller 21. In order to apply a sufficiently wide flatly adherent strip 34 to the transfer roller 21, the pressure roller 8 is concavely curved at its circumference in axial direction. This can be achieved for instance by the use of so-called Diabolo rollers. The pressure roller 28 presses the adhesive tape - as explained in the previous embodiment - onto transfer roller 21, while the sliding carriage travels over the entire work width. Subsequently, the pressure roller 28 is lowered and thereby the adhesive layer of the adhesive tape 24 is torn. In order to accelerate the application of the adhesive tape to the transfer roller 21, on each side of the machine an adhesive-tape dispenser 22 can be arranged, each of them applying the adhesive strips 34 to one half of the transfer roller 21. The transfer of the adhesive strips 34 to web 4 takes place as previously described by pressing the transfer roller 21 against the web 4.

Figure 4:
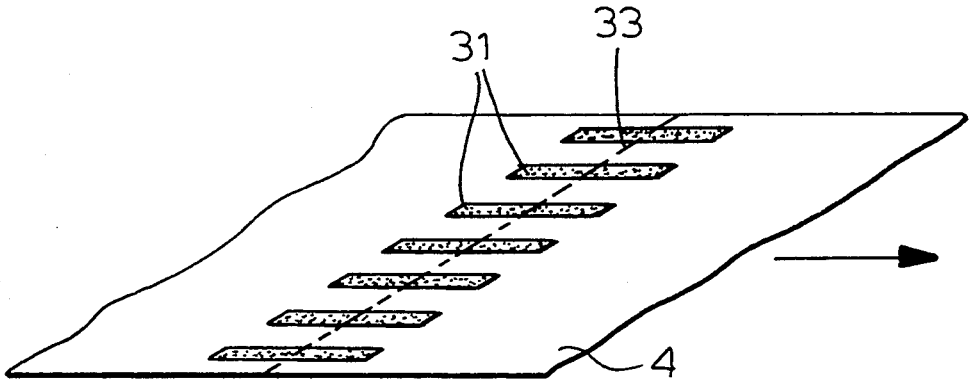
FIG. 4 shows a paper web with parallel adhesive strips applied in the direction of web travel.

A further embodiment is described in FIG. 4, wherein the two-sided adhesive strips are produced on the transfer roller 21 by spraying. For this purpose underneath the transfer roller 21 one or more glue nozzles 35 are provided, which are either arranged over the entire web width or can travel across the web. By means of these nozzles 35 one or more glue traces are sprayed for instance from a dispersion gluing device onto the transfer roller 21, these traces binding to form double-sided adhesive strips. Subsequently, they are transferred to web 4 in the aforedescribed manner.

We claim:

1. A method of winding a continuous web on a succession of cores comprising the steps of:

(a) longitudinally advancing the web looped about a working width of a guide roll to wind it in a winding roll resting on the guide roll;

(b) interrupting advance of the web and forming at a perforation station a crosswise perforation row in the web across the working width;

(c) longitudinally advancing a carrier tape with a twoface adhesive thereon in a loop about a pressure roller;

(d) thereafter urging the pressure roller toward a transfer roller extending across the working width and spaced from the guide roll and downstream of the perforation station to press and adhere the adhesive to the transfer roller;

(e) pulling the pressure roller away from the transfer roller, detaching thereby the carrier tape from the adhesive on the transfer roller;

(f) thereafter displacing the pressure roller transversely to the longitudinal advance of the web and repeating the steps (d) and (e) at subsequent delivery locations, thereby forming a plurality of adhesive strips spaced from one another and aligned along said working width on the transfer element;

(g) then swinging the transfer element toward the web to press the plurality of strips against the web for straddling both sides of the perforation row on the web upon resuming an advance of the web, thereby adhering the plurality of strips on the web along the working width;

(h) thereafter withdrawing the transfer roller from the web while longitudinally advancing the web with the plurality of strips adhered thereto toward the first winding roll;

(i) thereafter tearing the web longitudinally apart at the perforation row, forming thereby trailing and leading web ends;

(j) thereafter attaching the trailing web end to the winding roll and the leading end to a core to be wound; and (k) repeating steps (b) through (j).

2. The method defined in claim 1 wherein the step (i) includes a step of increasing the web traction by turning the winding roll against a braking force.

3. The method defined in claim 1 wherein the transfer roller is rotated back upon applying each of the plurality of strips to provide alignment thereof.

4. A method of winding a continuous web on a succession of cores comprising the steps of:

(a) longitudinally advancing the web looped about a working width of a guide roll along a web path to wind it in a winding roll resting on the guide roll;

(b) interrupting advance of the web and forming at a perforation station located upstream of the winding roll a crosswise perforation row in the web across the working width;

(c) activating dispatching means for applying a twoface adhesive strip on a transfer roll spaced from the web and located along the web path downstream of the perforation station;

(d) thereafter displacing the dispatching means transversely to the longitudinal advance of the web and repeating the step (c) at subsequent delivery locations, thereby forming a plurality of adhesive strips spaced from one another;

(e) while displacing the dispatching means toward a subsequent delivery location rotating the transfer roll to apply a respective subsequent adhesive strip at the respective location in alignment with the previous one across the working width;

(f) then swinging the transfer element toward the web to press the plurality of spaced apart and aligned strips against the web for straddling both sides of the perforation row on the web upon resuming an advance of the web, thereby adhering the row of strips on the web along the working width;

(g) thereafter withdrawing the transfer roller from the web while longitudinally advancing the web with the plurality of strips adhered thereto toward the first winding roll;

(h) thereafter tearing the web longitudinally apart at the perforation row, forming thereby trailing and leading web ends;

(i) thereafter attaching the trailing web end to the winding roll and the leading end to a core to be wound; and (j) repeating steps (b) through (i).

5. An apparatus for winding a continuous web on a succession of cores comprising:

drive means including a guide roll for longitudinally advancing a web extending across a working width of the guide roll to wind the web in a winding roll resting on the guide roll;

cutting means upstream of the winding roll for forming a crosswise perforation row across the working width;

a transfer roll along the path between the cutting means and the winding roll and juxtaposed with the guide roll across the working width, the transfer roll being spaced from the web in a receiving position and being swingable toward the web in a transferring position;

a pressure roll longitudinally guiding a carrier tape with a two-face adhesive strip thereon toward the transfer roll;

displacing means for sequential displacement of the pressure roll transversely across the working width between a plurality of delivery locations spaced apart across the working width;

actuator means for displacing the pressure roll toward the transfer roll to urge the carrier against the transfer roll in the receiving position thereof at each of the locations, and away from the transfer roll to detach the carrier from the adhesive, forming thereby a plurality of spaced apart and aligned adhesives strips on the transfer roll across the working width;

swinging means for swinging the transfer roll in said transferring position to press the plurality of adhesive strips against the web, each of the of adhesive strips straddling both sides of the perforation row upon running off the transfer roll;

means for tearing the web longitudinally apart at the perforation row to form leading and trailing web ends each provided with respective adhesive strips; and means for pressing the trailing web end on the winding roll and the leading end against a fresh core by engaging the respective adhesive strips thereagainst.

6. The apparatus defined in claim 5 further comprising:

means for replacing the winding roll with the fresh core; and means for rotating the transfer roll.

* * * * *